United States Patent [19]

Dameron

[11] Patent Number: 4,819,398

[45] Date of Patent: Apr. 11, 1989

[54] IMPROVED ROOF PANEL APPARATUS AND PANEL LOCKING METHOD

[76] Inventor: Joseph T. Dameron, 3357 E. Pennsylvania St., Tucson, Ariz. 85714

[21] Appl. No.: 123,240

[22] Filed: Nov. 20, 1987

[51] Int. Cl.[4] ..... E04D 1/00

[52] U.S. Cl. ..... 52/529; 52/533; 52/537; 52/542; 52/522; 52/588; 52/594

[58] Field of Search ..... 52/529, 523, 537, 542, 52/478, 522, 588, 594

[56] References Cited

U.S. PATENT DOCUMENTS

| | | | |
|---|---|---|---|
| 4,269,012 | 5/1981 | Mattingly et al. | 52/542 X |
| 4,358,916 | 11/1982 | Lacasse | 52/537 X |
| 4,505,084 | 3/1985 | Knudson | 52/537 X |

*Primary Examiner*—Carl D. Friedman
*Attorney, Agent, or Firm*—Victor Flores

[57] ABSTRACT

An elongated, substantially V-shaped roof panel and a roof panel interlocking method using the V-shaped roof panel, having the inclined sides of the V-shaped roof panel provided with elongated stair-stepping reinforcement ribs for purposes of producing a more rigid and stronger roof panel. At the terminating ends of each of the inclined sides there is provided a complementary mechanical lock design that produces a roof panel lock when a first terminating end member, of a plurality of identical roof panels, is mated with an adjoining second terminating end member of a plurality of identical roof panels. Each terminating end mechanical lock design is comprised of various bends in material, shaped such that when adjoining ends of a plurality of identical roof panels are interlocked, the various bends of each lock design are in a closely coupled relationship. The shape of the various bends in each end lock design is attributed with achieving an increasingly tighter bond between roof panels with increasingly higher wind forces experienced. The shape of the various bends used to produce a better lock, coincidentally creates a mini-gutter at the lock which helps prevent water siphoning at the lock and solves a problem which heretofore has not been succesfully solved.

10 Claims, 2 Drawing Sheets

IMPROVED ROOF PANEL APPARATUS AND PANEL LOCKING METHOD

FIELD OF THE INVENTION

The present invention generally relates to panel material used in the roof building industry. More particularly, the present invention relates to a substantially V-shaped roof panel and an interlocking roof panel interlocking method using the V-shaped roof panel, having opposed, reinforced inclined elongated side members which are provided with terminating end members each having a complementary mechanical design that produces a roof panel lock when a first terminating end member, of a plurality of identical roof panels, is mated with an adjoining second terminating end member of a plurality of identical roof panels.

DESCRIPTION OF THE PRIOR ART

The prior art, as known to the applicant, is limited to the several types of commercially available roof panels that utilize the same interlocking panel principle. These panels are commonly referred to by several names, such as "structural panel", "W" panel, twin "V" panel, "V" panel, "standing seam" roof panel or "flat pan" roof pan. The ends of these panels, while termed interlocking, fail to provide a lock between panels that can withstand wind forces in a compensating manner which is proportional to the wind force applied. Additionally, the lock resulting from using panels presently available have traditionally had a water siphoning action during a rain storm which is undesirable in that water leaks develop under the patio cover. While various attempts have been made at solving the siphoning action at the lock, none have had commercial success because of the unpractical nature of utilizing the devices. One such design known to the applicant would require a telescopic fit of adjoining panel, which is highly impractical in view of the elongated nature of the panels. Other problems with presently available roof panels is in the weak construction of the side walls in particular, the "V" panel designs.

Thus, a need exists for a roof panel which has ends that will interlock with an adjoining identical panel in a manner that is not any more difficult than presently available roof panels, preferably, one that has ends that interlock in a snap-fit manner, which manner is deemed easier than the interlocking method of roof panels presently available.

A need also exists for a roof panel which has a lock design at each end which will compensate proportionately for the amount of wind force applied to produce a stronger bond between panels as higher wind forces are experienced.

A need further exists for a roof panel which has a lock design between adjoining identical panels that prevents the water siphoning action that produces leaks under a patio cover.

Still a further need exists for a roof panel that is designed having side walls that are reinforced to produce a stronger roof panel.

SUMMARY OF THE INVENTION

Accordingly, it is an object of this invention to provide a roof panel having a lock design at each side end which is easy to install in a snap interlocking manner.

It is another object of this invention to provide a roof panel having a lock design which will produce a stronger bond at the lock in a compensating manner proportional to the amount of the wind force applied.

It is yet another object of the present invention to provide a roof panel having a lock design which will prevent water siphoning action at the lock between adjoining identical panels. Still another object of the present invention is to provide a roof panel that is provided as described above and is also provided with reinforced side walls to produce a stronger roof panel.

According to the invention, there is provided an elongated, substantially V-shaped roof panel having the inclined sides of the V-shaped roof panel provided with elongated stair-stepping reinforcement ribs for purposes of producing a more rigid and stronger roof panel. At the terminating ends of each of the inclined sides there is provided a complementary mechanical lock design that produces a roof panel lock when a first terminating end member, of a plurality of identical roof panels, is mated with an adjoining second terminating end member of a plurality of identical roof panels. Each terminating end mechanical lock design, comprised of various bends in material, is shaped such that when adjoining ends of a plurality of identical roof panels are interlocked, the various bends of each lock design are in a closely coupled relationship. The shape of the various bends in each end lock design is attributed with achieving an increasingly tighter bond between roof panels with increasingly higher wind forces experienced. The shape of the various bends used to produce a better lock, conincidentally creates a mini-gutter at the lock which helps prevent the water siphoning at the lock and thus solves a problem which heretofore has not been successfully been solved.

Threfore, to the accomplishments of the foregoing objects, the invention consists of the foregoing features hereinafter fully described and particularly pointed out in the claims, the accompanying drawing and following disclosure describing in detail the invention, such drawing and disclosure illustrating, however, but one of the various ways in which the invention may be practiced.

DETAILED DESCRIPTION OF THE PREFERRED EMBODIMENT

Figure 1:
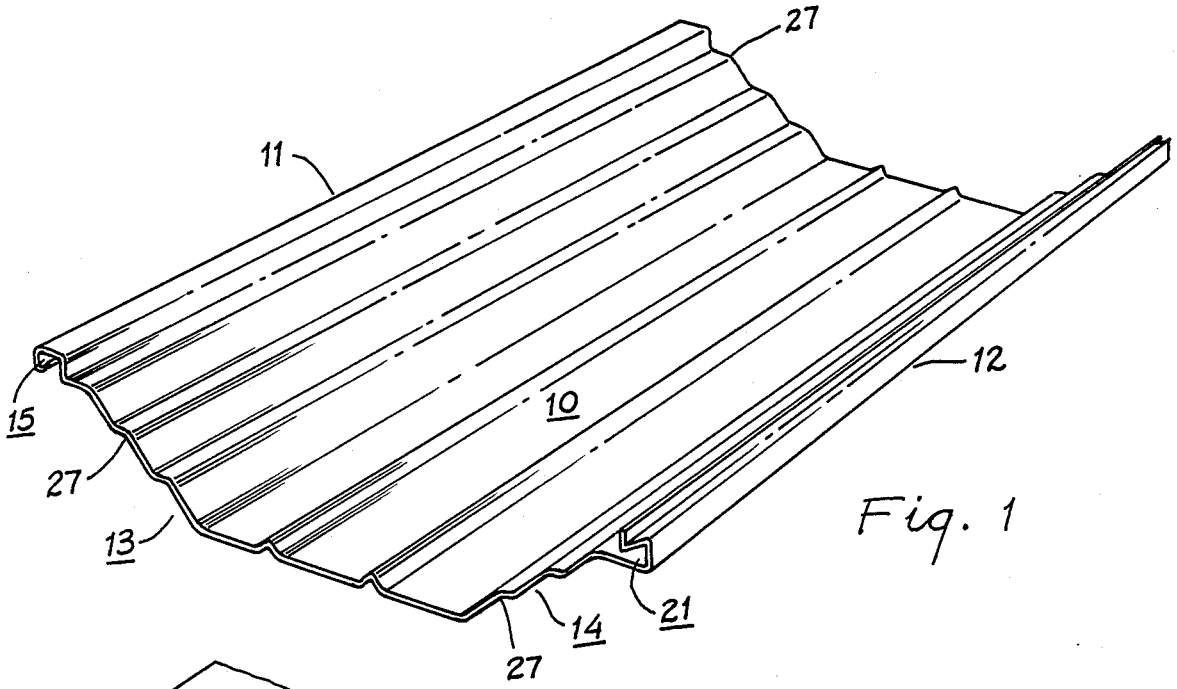
FIG. 1 shows a perspective view of the present invention illustrating the two different mechanical lock designs used in an interconnected roof panel system.

Referring now to FIG. 1 there is shown the V-shaped roof panel 10 of the present invention having opposed inclined sides 13 and 14 having terminating ends 11 and 12 which are provided respectively with a first interlocking member 15 and a second interlocking member 21.

Figure 2:
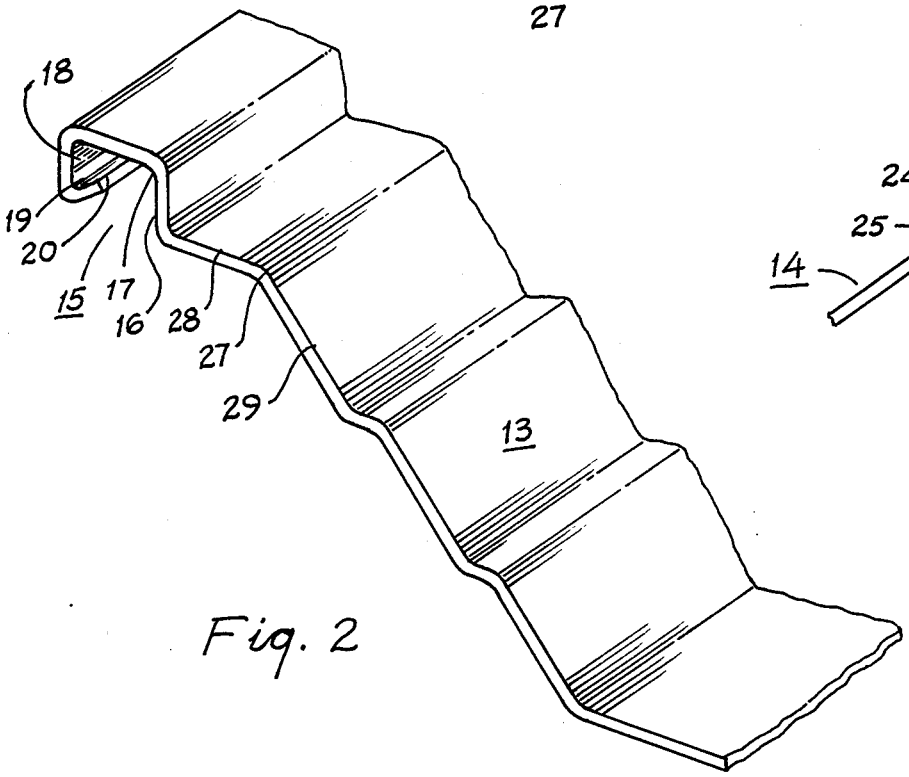
FIG. 2 shows a partial, fragmented perspective view of one inclined side of the present invention illustrating the design of a first interlocking member of the interlocked roof panel system and also the reinforcing stair-stepping

As best seen in FIG. 2, inclined side 13 is provided with stair-stepping portions 28 and 29 which create therebetween a reinforcement rib 27 to produce an overall more rigid and stronger V-shaped roof panel. Also shown in FIG. 2 is an enlarged view of the shape of interlocking member 15. The integral shape is shown to include, a vertical bend 16, extending from side portion 28, upward to horizontal bend 17 which turns downward at bend 18 and continues downward to bend 19 which then turns upward at approximately a 45 degree angle with the horizontal to terminating end 20.

Figure 3:
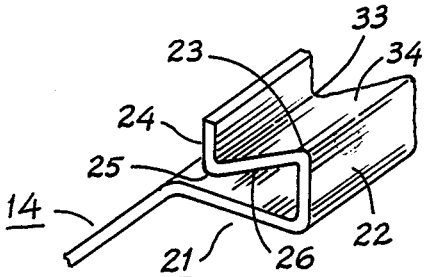
FIG. 3 shows a partial, fragmented perspective view of a second interlocking member of the interlocked roof panel system illustrating the design required for mating with the first interlocking member.

Referring now to FIG. 3, where the integral shape of interlocking member 21 includes vertical bend 21 extending upward from a side portion similar to side portions 28, to bend 23, whereat bend 23 turns downward towards side 14 to again bend upward at bend 25 to terminate at end 24. Also shown in FIG. 3 is inclined side lock member 34 and a mini-gutter 33 created therebetween end 24 and inclined side 34, which combination helps prevent water siphoning action.

Figure 4:
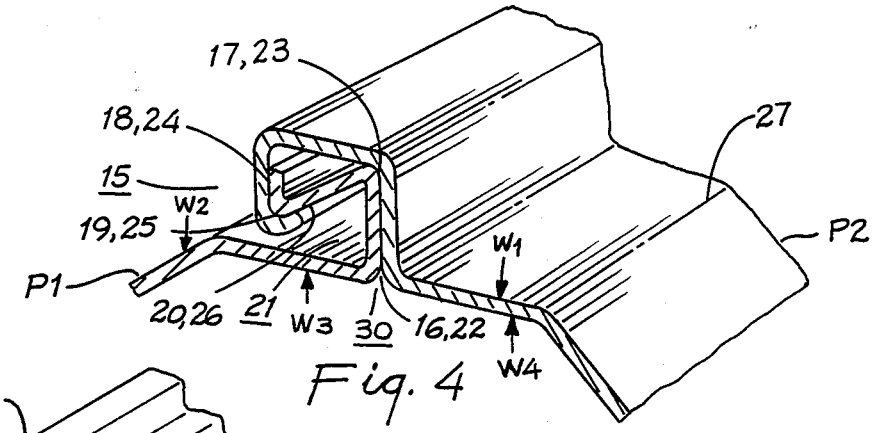
FIG. 4 shows an enlarged, partial perspective view of a first interlocking member and a second interlocking member mated to form an interlocked panel joint.

Referring now to FIG. 4, where roof panel P1, having interlocking member 21 is interlocked with roof panel P2 having interlocking member 15 to produce lock 30. Shown here also are the closely coupled relationship between the various bends of each interlocking member, namely, that of bends 16, 22 and 17, 23 and 18, 24 and 19, 25 and 20, 26. The lock 30, produced as shown here, will become increasingly tighter as wind forces, W1, W2, W3 and W4, on P1 and P2 become stronger. The shapes as shown in FIG. 4 and herein previously described and coupled as shown are attributed for the resulting increasingly tighter lock produced with increasingly stronger wind forces. Also in this combination of closely coupled bends, water siphoning action could potentially start at 20, 26 up to 19, 25 and up to 18, 24. However, because of the design at 18, 24, a break in any siphoning action would occur, resulting in water being gravitationally directed into mini-gutter 33, best seen in Fig. 3. Likewise, any water siphoning started at 17, 23, would result in water being directed toward inclined side 34.

Figure 5:
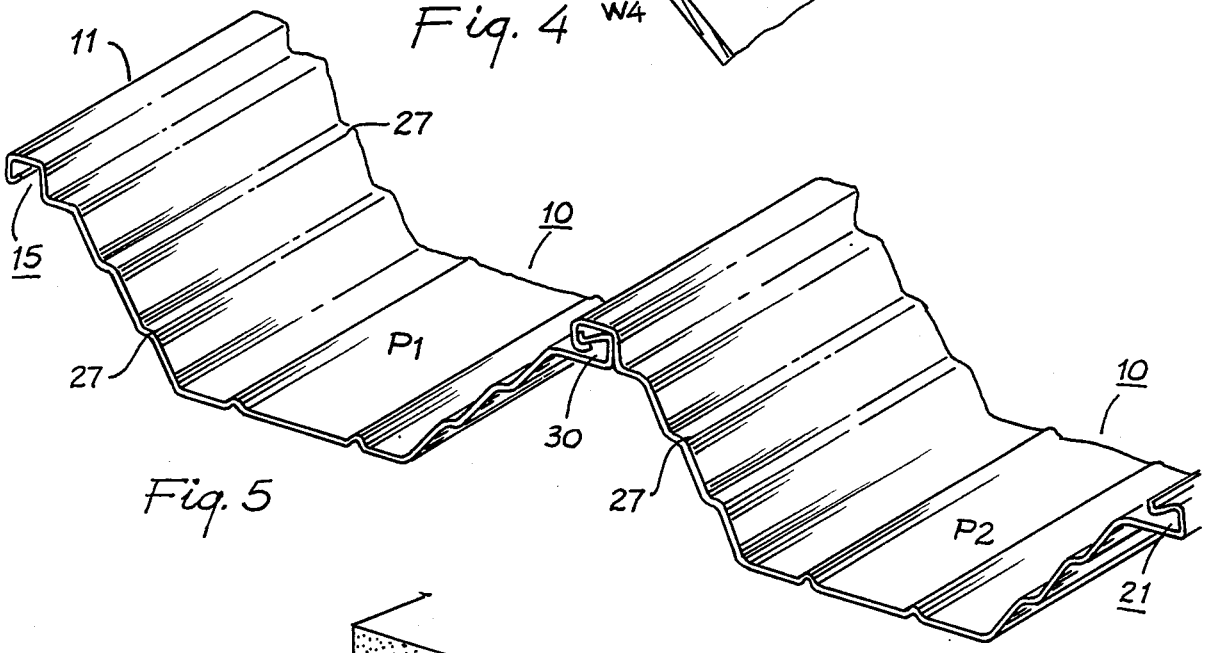
FIG. 5 shows a perspective view of two identical roof panels of the present invention mated as shown in FIG. 4.
Figure 6:
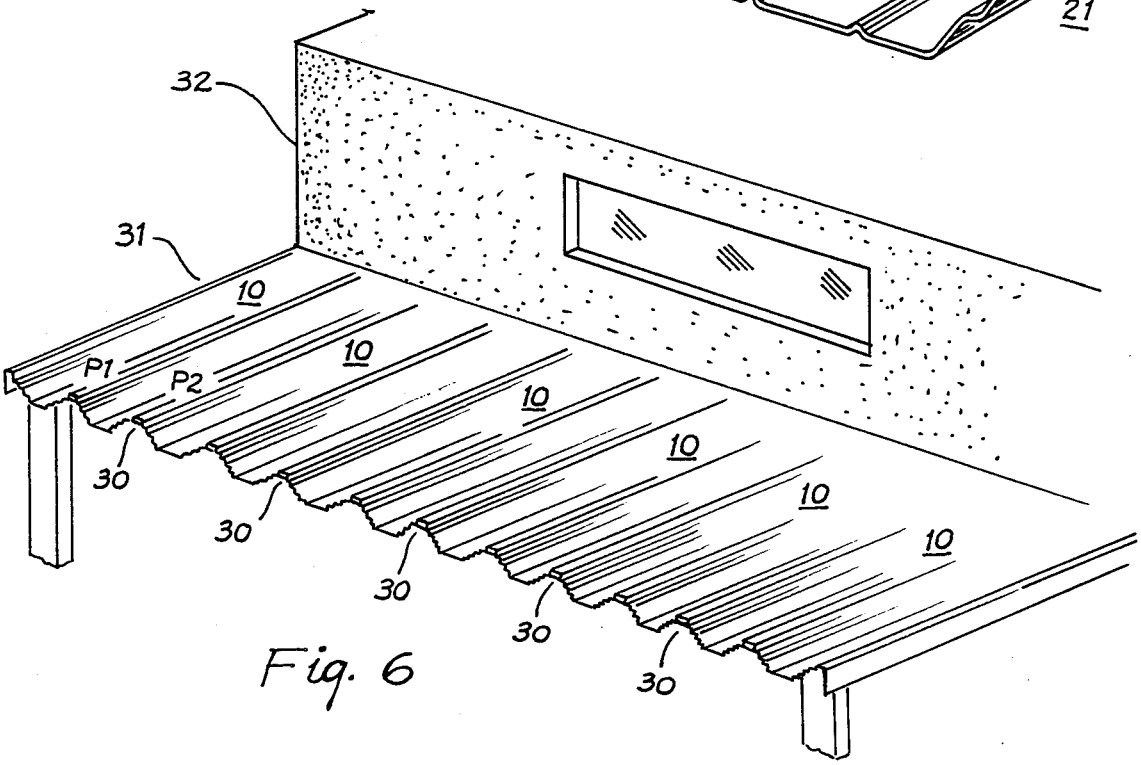
FIG. 6 is a perspective view of an application of the present invention.

FIG. 5 shows two identical roof panels 10, of the present invention, designated P1 and P2 interlocked with a lock 30. P1 and P2 locked as shown is typical of a roof panel system utilizing the roof panel of the present invention. The interlocking method being easily acomplished by overlapping one panel over the other and snap-fitting the two interlocking members 15 and 21. Ribs 27 add rigidity to the interlocking process. FIG. 6 shows a typical patio cover appication 31 attached to a structure 32 using a plurality of roof panel 10 interlocked with lock 30.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A roof panel and roof panel lock, said roof panel and roof panel lock comprising:

(a) a first, manually snap-fitting, interlocking member of a roof panel lock, said first interlocking member including:

(i) a first vertical member integrally extending upward from an end of a first side member or said roof panel, (ii) an angled member integrally extending downward from said first vertical member, (iii) a second vertical end member integrally extending upward from said angled member and parallel to said first vertical member, said second vertical end member being shorter than said first vertical member, and (iv) a substantially small, gutter-like portion being formed therebetween said angled member and said second vertical member;

(b) a second, manually snap-fitting, interlocking member of a roof panel lock, said second interlocking member includes:

(i) a first vertical member integrally extending from an end of a second side member of said roof panel, (ii) a horizontal member integrally extending outwardly from said first vertical member, (iii) a second vertical member integrally extending downwardly from said horizontal member and parallel to said first vertical member, and (iv) an angled end member integrally extending inwardly and upwardly from said second vertical member; and (c) a roof panel lock, said roof panel lock being formed by mating, in a manually snap-fitting manner, said first interlocking member of a first roof panel with an adjoining second interlocking member of an other identical roof panel, said first and second interlocking members being designed to have respective lock members that direct siphoned moisture to said substantially small, gutter-like portion on said first interlocking member, said roof panel lock having a locking shape that compensates to produce a tighter lock when increasingly stronger wind forces are experienced.

2. A roof panel as recited in claim 1, further comprising:

a plurality of roof panels interlocked side by side and provided with said roof panel lock.

3. A rib reinforced, substantially V-shaped roof panel and roof panel lock, said roof panel and roof panel lock comprising:

(a) a first inclined side member on a roof panel, said first inclined side member being elongated and having a lower end and an upper end;

(b) a second inclined side member on said roof panel opposed to said first inclined side member, said second inclined side member being elongated and having an upper end and a lower end, said lower end being integrally connected to said lower end on said first inclined side member;

(c) a first, manually snap-fitting, interlocking member of a roof panel lock, said first interlocking member being located at said upper end of said first inclined side member, said first inerlocking member including:

(i) a first vertical member integrally extending upward from said upper end of said first inclined side member, (ii) an angled member integrally extending downward from said first vertical member towards said first inclined side member, (iii) a second vertical end member integrally extending upward from said angled member and parallel to said first vertical member, said second vertical end member being shorter than said first vertical member, and (iv) a substantially small, gutter-like portion formed therebetween said angled member and said second vertical member;

(d) a second, manually snap-fitting, interlocking member of a roof panel lock, said second interlocking member being located at said upper end of said second inclined side member, said second interlocking member includes:

(i) a first vertical member integrally extending from said upper end of said second inclined side member, (ii) a horizontal member integrally extending outwardly from said first vertical member and parallel to said upper end of said second inclined side member, (iii) a second vertical member integrally extending downardly from said horizontal member and parallel to said first vertical member, and (iv) an angled end member integrally extending inwardly and upwardly from said second vertical member;

(e) a roof panel lock, said roof panel lock being formed by mating, in a manually snap-fitting manner, said first interlocking member of a first roof panel with an adjoining second interlocking member of an other identical roof panels, said first and second interlocking members being designed to have respective lock members, including said angled member and said second vertical end member on said first interlocking member and said second vertical member and said angled end member on said second interlocking member, that direct siphoned moisture to said substantially small, gutter-like portion, said roof panel lock having a locking shape that compensates to produce a tighter lock when increasingly stronger wind forces are experienced; and (f) a plurality of roof panels provided with said roof panel lock.

4. A substantially V-shaped roof panel as recited in claim 3, further comprising:

a plurality of roof panels interlocked side by side and provided with said roof panel lock.

5. A method of building a roof using interlocked roof panels, said method comprising the steps of:

(a) providing a plurality of identical roof panels having sides terminating in respective first and second interlocking members of a roof panel lock, (i) said first interlocking member including:

a first vertical member integrally extending upward from an end of a first side member of said roof panel, an angled member integrally extending downward from said first vertical member, a second vertical end member integrally extending upward from said angled member and parallel to said first vertical member, said second vertical end member being shorter than said first vertical member, and a substantially small, gutter-like portion being formed therebetween said angled member and said second vertical member, (ii) said second interlocking member includes:

a first vertical member integrally extending from an end of a second side member of said roof panel, a horizontal member integrally extending outwardly from said first vertical member, a second vertical member integrally extending downwardly from said horizontal member and parallel to said first vertical member, and an angled end member integrally extending inwardly and upwardly from said second vertical member;

(b) placing said plurality of roof panels in a side by side manner on a structure for building a roof;

(c) anchoring a first roof panel to said structure;

(d) overlapping a side of a second roof panel over an unanchored side of said first roof panel;

(e) lifting opposite side of said second roof panel in a hinge-like manner about said overlapped sides of said first and second roof panel;

(f) positioning said first and second interlocking members on said overlapped sides for locking;

(g) locking said positioned overlapped sides by lowering in a hinge-like manner;

(h) anchoring said locked first and second roof panel to said structure; and (i) repeating said steps of overlapping, lifting, positioning, locking and anchoring using said plurality of provided identical roof panels.

6. A method of building a roof using interlocked roof panels according to claim 5, wherein said step of locking further includes:

creating a roof panel lock having a locking shape that compensates to produce a tighter lock when increasingly stronger wind forces are experienced.

7. A substantially V-shaped, rib reinforced, roof panel and roof panel lock, said roof panel and roof panel lock comprising:

(a) a first inclined side member on a roof panel, said first inclined side member being elongated and having a lower end and an upper end;

(b) a second inclined side member on said roof panel opposed to said first inclined side member, said second inclined side member being elongated and having an upper end and a lower end, said lower end being integrally connected to said lower end on said first inclined side member;

(c) a first, manually snap-fitting, interlocking member of a roof panel lock, said first interlocking member being located at said uppe end of said first inclined side member;

(d) a second, manually snap-fitting, interlocking member of a roof panel lock, said second interlocking member being located at said upper end of said second inclined side member; and (e) a roof panel lock, said roof panel lock being formed by mating, in a manually snap-fitting manner, said first interlocking member of a first roof panel with an adjoining second interlocking member of an other identical roof panels, said first and second interlocking members being designed to have respective lock members that direct siphoned moisture to a substantially small, gutter-like portion on one of said interlocking members, said roof panel lock having a locking shape that compensates to produce a tighter lock when increasingly stronger wind forces are experienced, said first interlocking member including:

(i) a first vertical member integrally extending upward from said upper end of said first inclined side member, (ii) an angled member integrally extending downward from said first vertical member towards said first inclined side member, (iii) a second vertical end member integrally extending upward from said angled member and parallel to said first vertical member, said second vertical end member being shorter than said first vertical member, and (iv) said substantially small, gutter-like portion being formed therebetween said angled member and said second vertical member.

8. A substantially V-shaped roof panel as recited in claim 7, further comprising:

a plurality of roof panels interlocked side by side and provided with said roof panel lock.

9. A substantially V-shaped, rib reinforced, roof panel and roof panel lock, said roof panel and roof panel lock comprising:

(a) a first inclined side member on a roof panel, said first inclined side member being elongated and having a lower end and an upper end;

(b) a second inclined side member on said roof panel opposed to said first inclined side member, said second inclined side member being elongated and having an upper end and a lower end, said lower end being integrally connected to said lower end of said first inclined side member;

(c) a first, manually snap-fitting, interlocking member of a roof panel lock, said first interlocking member being located at said upper end of said first inclined side member;

(d) a second, manually snap-fitting, interlocking member of a roof panel lock, said second interlocking member being located at said upper end of said second inclined side member; and (e) a roof panel lock, said roof panel lock being formed by mating, in a manually snap-fitting manner, said first interlocking member of a first roof panel with an adjoining second interlocking member of an other identical roof panels, said first and second interlocking members being designed to have respective lock members that direct siphoned moisture to a substantially small, gutter-like portion on one of said interlocking members, said roof panel lock having a locking shape that compensates to produce a tighter lock when increasingly stronger wind forces are experienced, said second interlocking member includes:

(i) a first vertical member integrally extending from said upper end of said second inclined side member, (ii) a horizontal member integrally extending outwardly from said first vertical member and parallel to said upper end of said second inclined side member, (iii) a second vertical member integrally extending downwardly from said horizontal member and parallel to said first vertical member, and (iv) an angled end member integrally extending inwardly and upwardly from said second vertical member.

10. A substantially V-shaped roof panel as recited in claim 9, further comprising:

a plurality of roof panels interlocked side by side and provided with said roof panel lock.

* * * * *